US006290488B1

(12) United States Patent
Shu

(10) Patent No.: US 6,290,488 B1
(45) Date of Patent: Sep. 18, 2001

(54) HEAT-STORAGE INCINERATOR

(76) Inventor: Chia-Ching Shu, No. 100, Ming-Chuan Rd., San-Yeh Village, Lu-Chu Hsiang, Kaohsiung (TW)

( * ) Notice: Subject to any disclaimer, the term of this patent is extended or adjusted under 35 U.S.C. 154(b) by 0 days.

(21) Appl. No.: 09/487,277

(22) Filed: Jan. 19, 2000

(51) Int. Cl.[7] ..... F01N 3/10

(52) U.S. Cl. ..... 431/170; 431/5; 431/7; 431/215; 422/175; 422/177; 422/182

(58) Field of Search ..... 431/5, 7, 12, 170, 431/215, 75; 422/183, 168, 175, 177, 178, 180, 182

(56) References Cited

U.S. PATENT DOCUMENTS 4,730,599 * 3/1988 Kendall et al. ..... 431/215
5,024,817 * 6/1991 Mattison ..... 422/175
5,376,340 * 12/1994 Bayer ..... 431/5
5,460,789 * 10/1995 Wilhelm ..... 422/173
5,589,142 * 12/1996 Gribbon ..... 431/5
5,941,697 * 8/1999 Chaouki et al. ..... 431/7
6,086,828 * 7/2000 Thompson ..... 422/173

FOREIGN PATENT DOCUMENTS

1249266 * 8/1986 (SU) ..... 431/5

* cited by examiner

*Primary Examiner*—Carl D. Price
(74) *Attorney, Agent, or Firm*—Rosenberg, Klein & Lee

(57) ABSTRACT

An incinerator with a heat-storage capability is disclosed. The incinerator has a housing with multiple communicating chambers defined therein, heat-storing medium received in each chamber, a heater mounted in the housing, an inlet tube and an outlet tube connecting to all of the chambers respectively, a control valve mounted between the inlet tube or outlet tube and each corresponding chamber and an air pump mounted on the outlet tube. The incinerator can deal with the industrial waste steam by the medium in alternate chambers one after the other, and the medium can absorb the heat generated by burning the volatile organic material in the industrial waste steam. This can increase the thermal efficiency of the incinerator and decrease cost of operating the incinerator.

10 Claims, 7 Drawing Sheets

HEAT-STORAGE INCINERATOR

BACKGROUND OF THE INVENTION

1. Field of the Invention

The present invention relates to an incinerator, and more particularly to an incinerator with a heat-storage capability for burning away volatile organic material in industrial waste steam.

2. Description of Related Art

In order to clean an industrial waste steam, a filter device for cleaning the steam, a dust collector device for collecting dust in the steam or an incinerator for burning the volatile substances in waste steam is always used in conjunction with an industrial apparatus or process. The incinerator is more efficient than the other devices for cleaning the waste steam. The incinerator in accordance with the prior art often uses direct lighting or a heat-exchange technique to burn the volatile substances in waste steam. However, the difference between the residual inlet and outlet temperature in a conventional incinerator is so small that heat must be constantly added thereby causing significant heat energy loss. This will increase the cost of using the conventional incinerator.

To overcome the shortcomings, the present invention tends to provide an improved incinerator to mitigate or obviate the aforementioned problems.

SUMMARY OF THE INVENTION

The main objective of the invention is to provide an improved incinerator with a heat-storage capability having a housing with multiple communicating chambers defined therein and a heat-storing medium in each chamber. The medium can absorb the heat caused by burning the volatile organic material in the industrial waste steam and be used to preheat the inlet steam by the medium. Preheating the steam at or near the inlet to the incinerator before adding heat from an external source will decrease the cost of using the incinerator.

Other objects, advantages and novel features of the invention will become more apparent from the following detailed description when taken in conjunction with the accompanying drawings.

DETAILED DESCRIPTION OF PREFERRED EMBODIMENT

Figure 1:
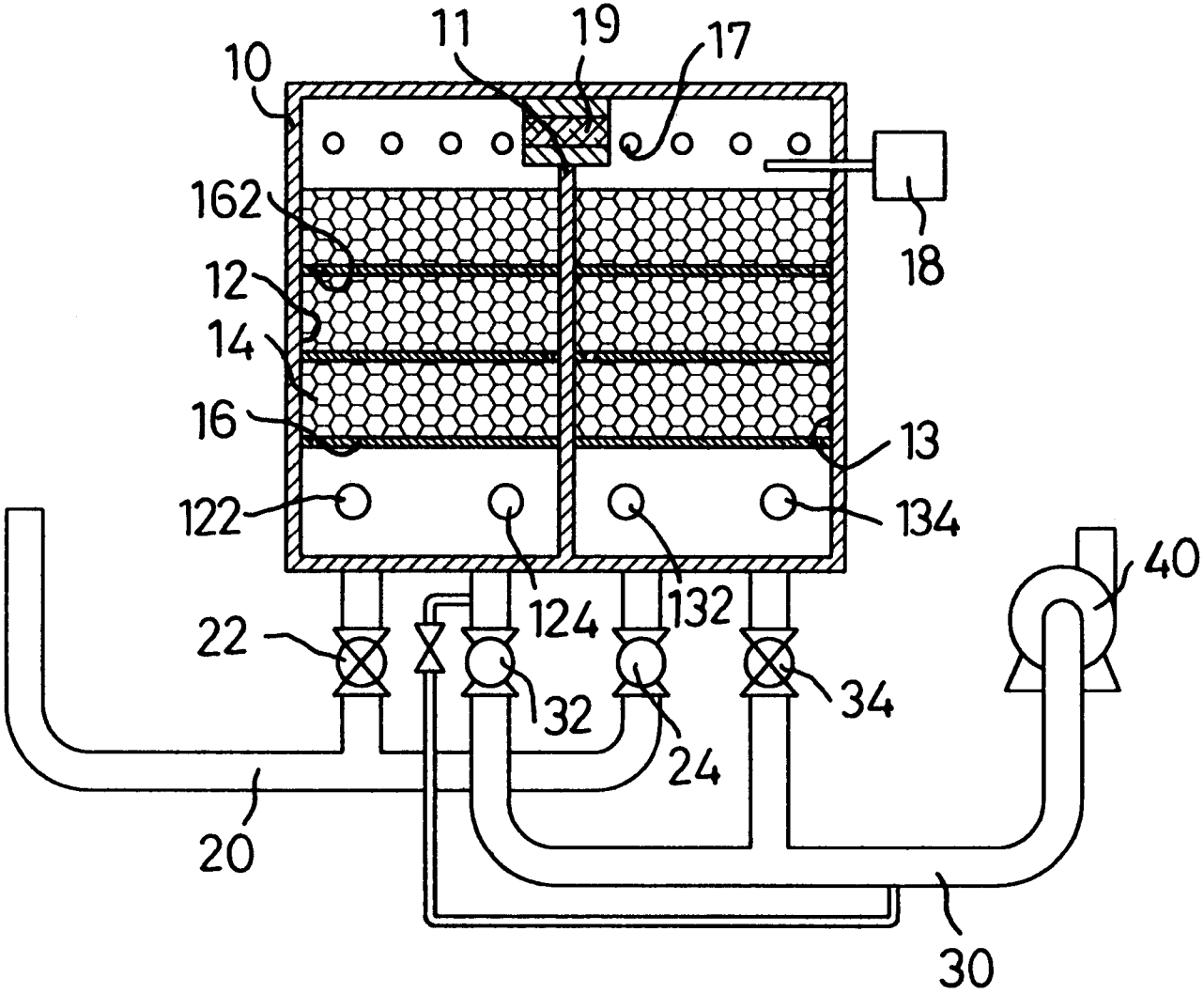
FIG. 1 is a schematic plan view in partial section of an incinerator in accordance with the present invention.
Figure 2:
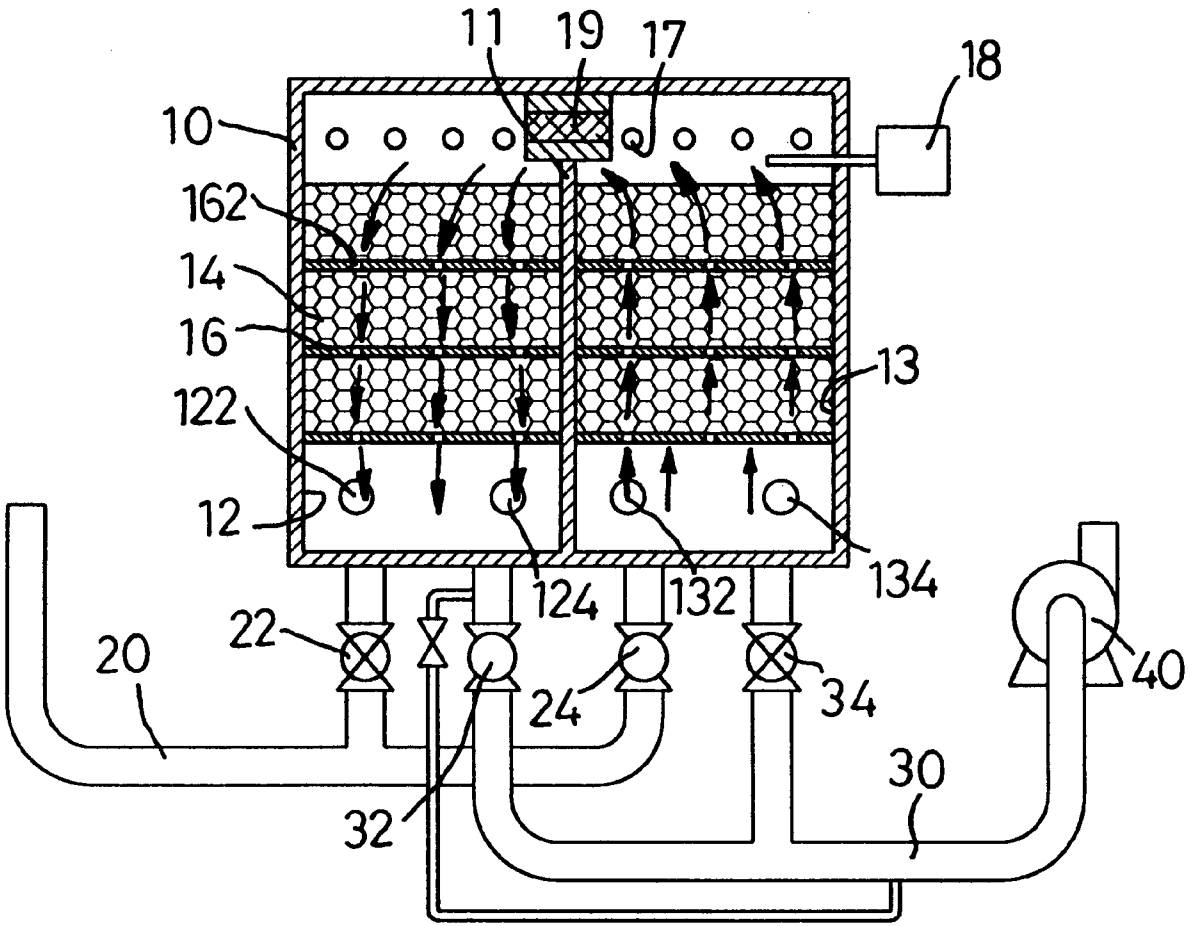
FIG. 2 is a schematic plan view in partial section of another embodiment of the incinerator in accordance with the present invention.

Referring to FIGS. 1 and 2, an incinerator in accordance with the present invention comprises a housing (10), an inlet tube (20) and an outlet (30) connected to the housing (10). The housing (10) has at least one internal partition wall (11) to define multiple communicating chambers (12, 13) inside the housing (10). Each chamber (12, 13) has multiple levels containing heat-storing medium (14) such as rock. A heater (17) is mounted in the housing (10). Each chamber (12, 13) has an inlet (122, 132) and an outlet (124, 134) connected to the inlet tube (20) and the outlet tube (30), respectively. A control valve (22, 24, 32, 34) is mounted on the inlet tube (20) or outlet tube (30) at each inlet (124) and outlet (132) to each chamber (12, 13). A control device opens and closes the control valves (22, 24, 32, 34). An air pump (40) is attached to the outlet tube (40) to draw the air through the chambers (12, 13) and the inlet and outlet tubes (20, 30).

Figure 3:
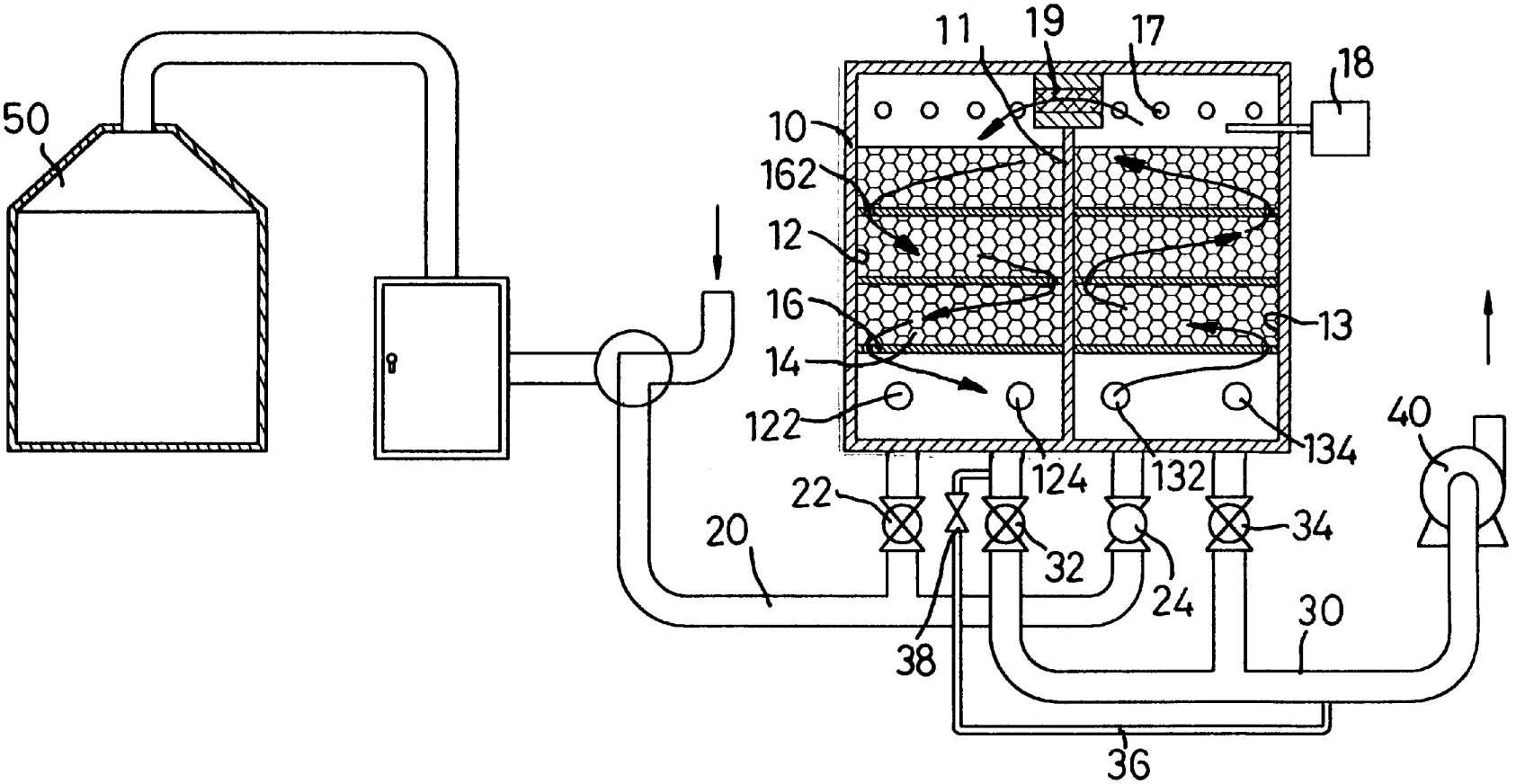
FIG. 3 is a schematic plan view in partial section of the incinerator in FIG. 1 showing a preheating process.

In operation, referring to FIG. 3, the inlet tube (20) is connected to an industrial apparatus (50), such that the waste steam generated by the industrial apparatus (50) can be directed into the housing (10) through the inlet tube (20). Before the incinerator can operate properly, the heat storing medium in the incinerator must be preheated. A control valve (24) connected to the inlet (132) of one of the chambers (12, 13) is kept open by the control device, and all of the other control valves (22, 32, 34) are kept closed. The air is directed into the chamber (13) through the open valve (24) and the corresponding inlet (132), and the heater (17) heats the air. The heated air will flow into the other chamber (12). The heat-storing medium (14) in the chamber (12) will be heated by absorbing the heat from the heated air. When the temperature of the heat-storing medium (14) increases to a desired level (about 700° C.), the preheating process of the incinerator is complete. A bypass line (36) with a high temperature control valve (38) is connected between the outlet tube (30) and the outlet (124) around the outlet control valve (32) to allow the heated air to flow out of the chamber (12).

Figure 4:
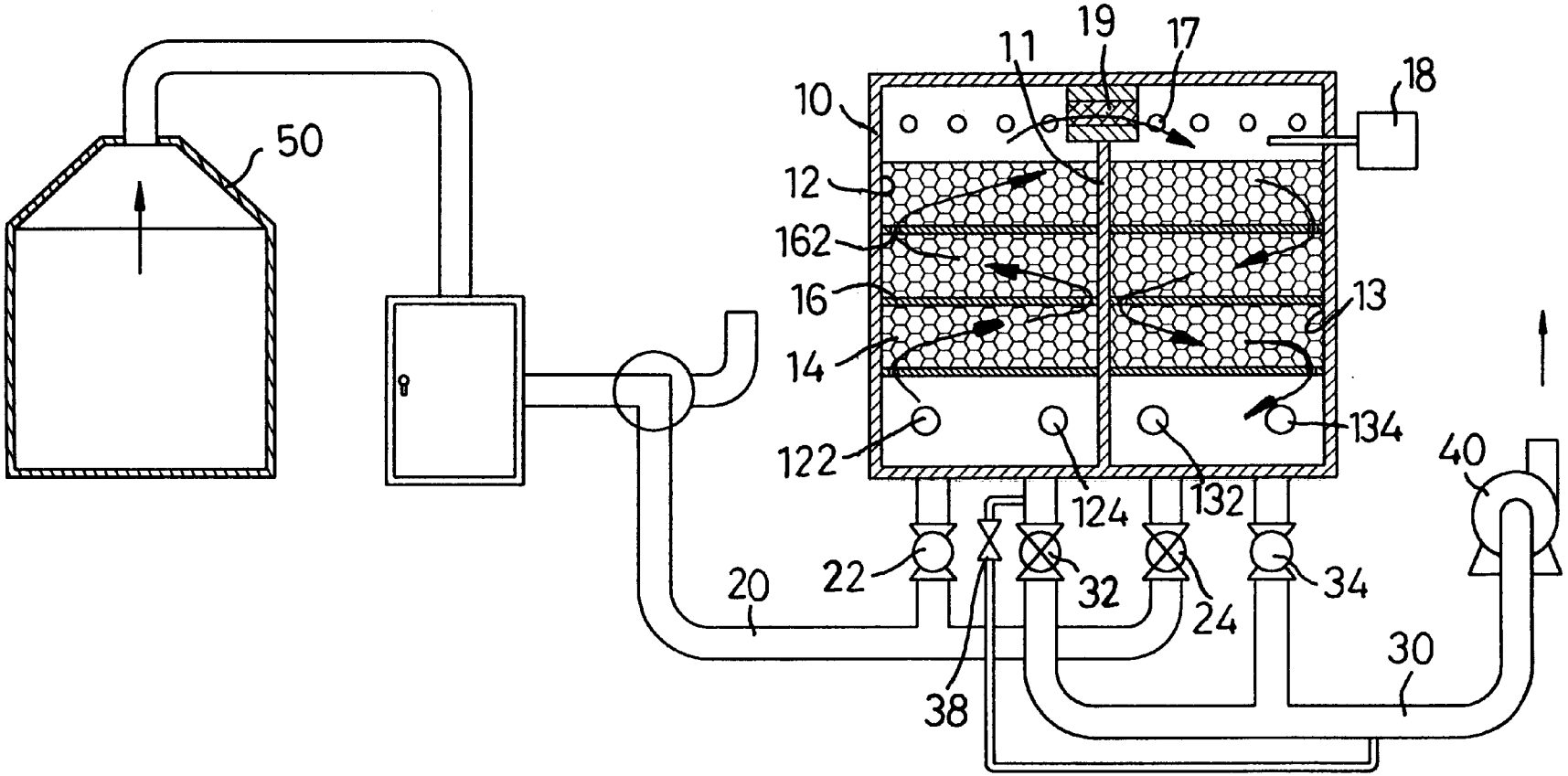
FIG. 4 is a schematic plan view in partial section of the incinerator in FIG. 1 connected to an industrial apparatus for dealing with the waste steam in one direction.

In proper operation, referring to FIG. 4, the bypass valve (38) is first closed, and the control the valves (22, 34) connected to the inlet (122) of the chamber (12) which has completed preheating and connected to the outlet (134) of the other chamber are opened. The other control valves (24,32) are kept closed. Thus, the waste steam generated by the industrial apparatus (50) will be directed into the chamber (12) through the inlet tube (20) and the corresponding inlet (122), and the volatile organic material in the steam will be ignited as it flows through the heated medium (14) in the chamber (12). Consequently, the volatile organic material will be burned away before the steam flows into the other chamber (13), and the cleaning effect of the steam is achieved. Furthermore, when the cleaned steam flows into the other chamber (13), the heat-storing medium (14) in that chamber (13) will absorb the heat from the steam and the temperature of the medium (14) will increase. Thereby, the medium (14) will be preheated before the steam flows out of the chamber (13) through the outlet (134) and the outlet tube (30).

Figure 5:
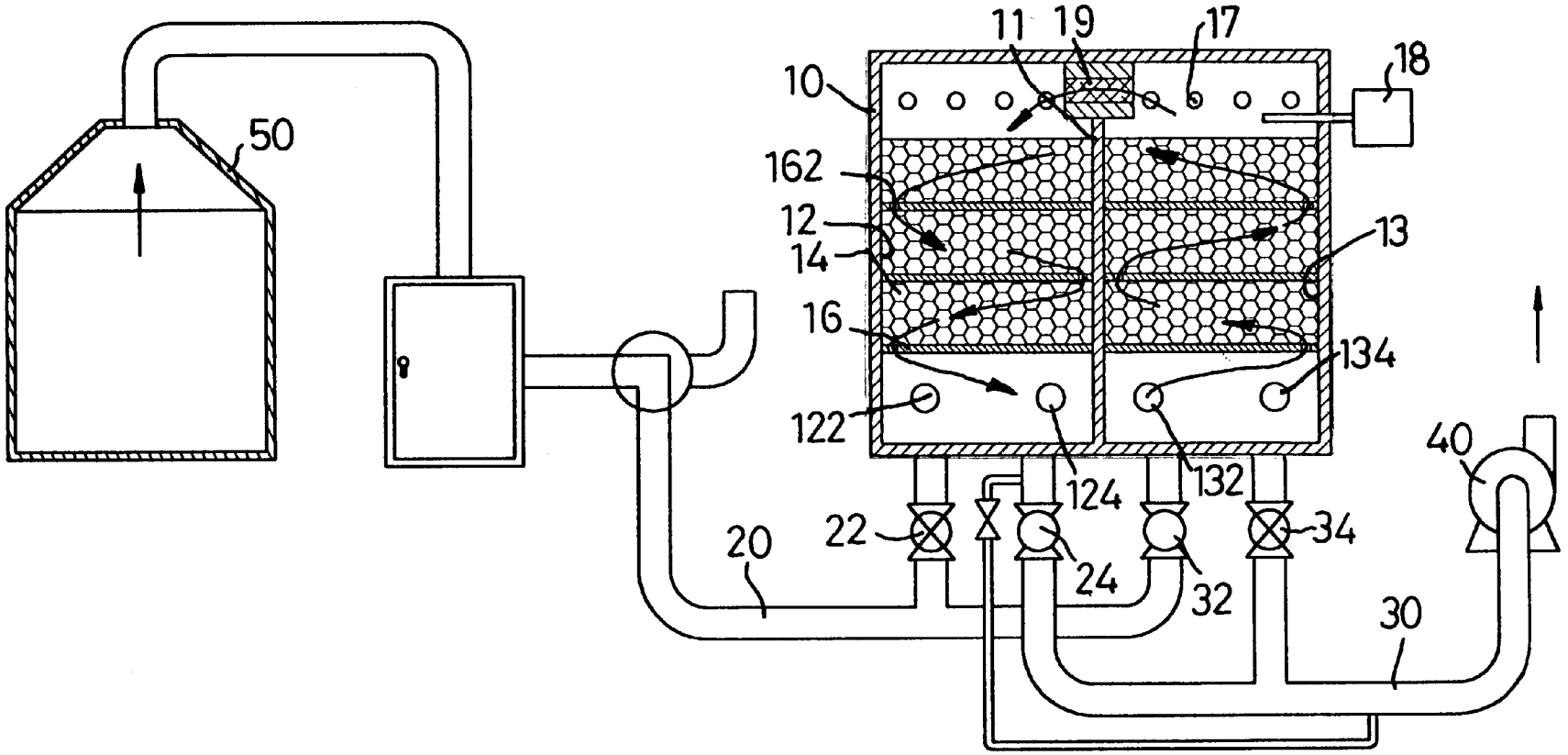
FIG. 5 is a schematic plan view in partial section of the incinerator in FIG. 1 dealing with the industrial waste steam in another direction.

With reference to FIG. 5, when the temperature of the medium (14) which burns the volatile organic material in the steam decreases to a specified level, the control valves (22, 24, 32, 34) will switch states by the control device, i.e. the open control valves (22, 34) will be closed, and the closed control valves (24,32) will be opened. Thus, the waste steam will be directed into the chamber (13) which has been preheated by the steam in the previous process, and the volatile organic material in the steam will be burned away by the heated medium (14) in that chamber (13). When the cleaned steam flows into the other chamber (12), the steam will heat the medium (14) in that chamber (12). Consequently, the incinerator deals with the industrial waste steam by the medium (14) in the chambers (12,13) one after the other. This can increase the thermal efficiency of the incinerator and decrease the cost of using it.

In addition, a temperature sensor (18) is mounted in the housing (10). When the temperature of the medium (14) is not at the desired level, the sensor (18) will ignite the heater (17) to heat the medium (14). Because the heater (17) is only used to heat the medium (14) to a predetermined temperature but not in burning the volatile organic material in the steam, the operating cost and the energy consumed is less than a conventional incinerator.

In a preferable embodiment, the heat-storing medium (14) is rock with a diameter between 10 millimeters (mm) to 30 mm to achieve the heat-storing effect.

Referring to FIGS. 1, 2, 3 and 6, at least one insulation layer (16) is laterally, longitudinally or crisscross mounted in each chamber (12,13) so as to divide each chamber (12,13) into multiple storage areas for receiving the medium (14). An orifice (162) is defined in each insulation layer (16) for the steam to flow through. By such an arrangement, the medium (14) in different storage areas has a different temperature, thus the incinerator will have a preferable operation effect. Moreover, when the medium (14) does not have enough heat-storing capability after long usage, the user only has to replace the medium (14) in the storage area where the medium (14) is worn out, but not all of the medium (14) in the chamber (12,13).

Figure 6:
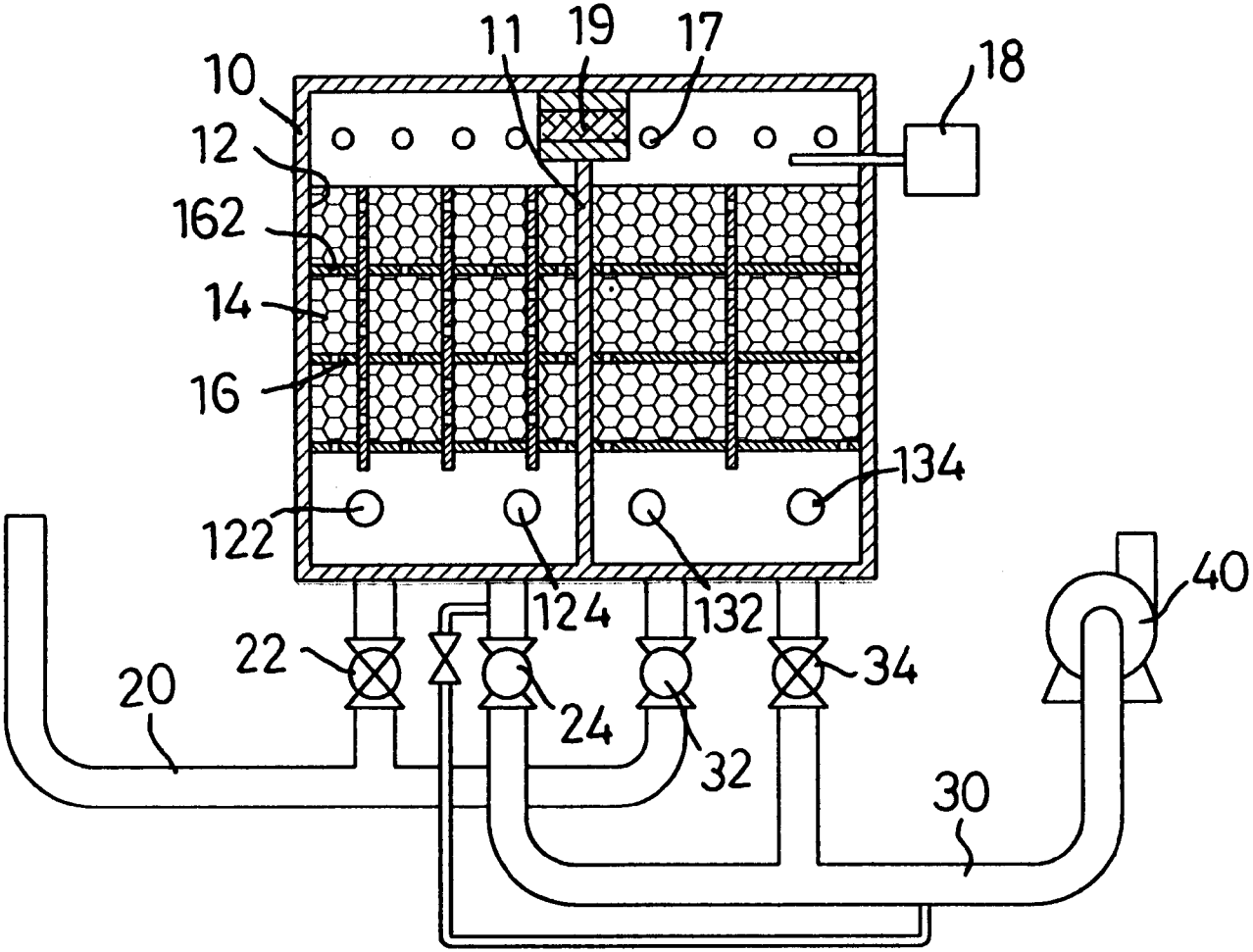
FIG. 6 is a schematic plan view in partial section of another embodiment of the incinerator in FIG. 1.
Figure 7:
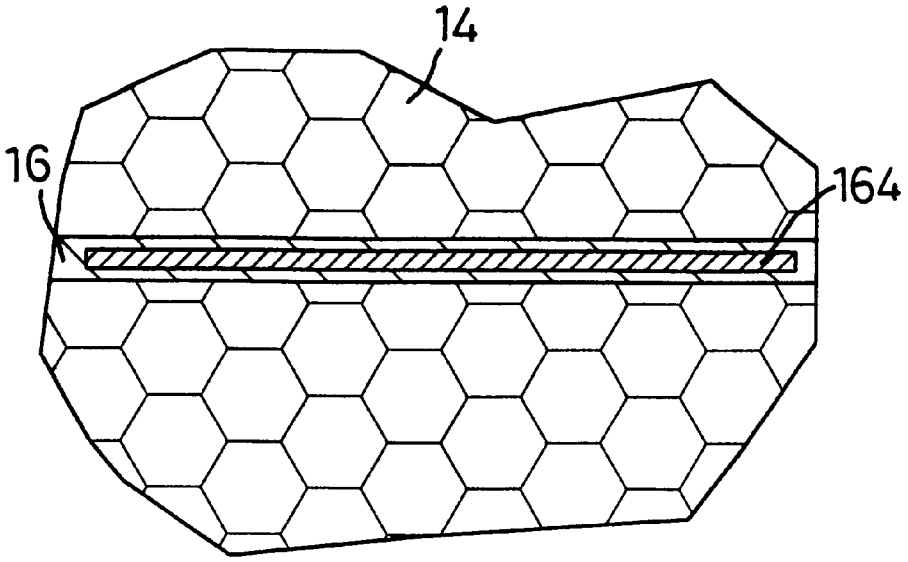
FIG. 7 is an enlarged plan view of the incinerator in FIG. 1 showing a heater laterally mounted in the insulation layer.
Figure 8:
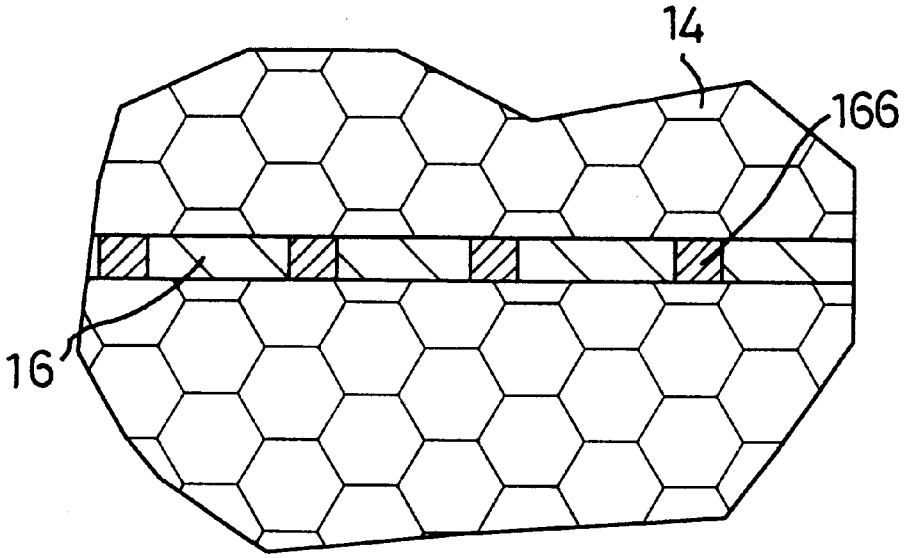
FIG. 8 is an enlarged plan view of the incinerator in FIG. 1 showing heaters longitudinally mounted in the insulation layer.

Referring to FIGS. 1, 2, and 6, the orifice (162) in each insulation layer (16) is located at a position away from the orifice (162) of the adjacent insulation layer (16). Thus, the steam will flow in a spiral through the storage areas. This can properly burn away the volatile organic material in the industrial waste steam and increase the heat absorbing effect of the mediums (14). Referring to FIGS. 7 and 8, at least one heater (164, 166) is laterally or longitudinally mounted in the insulation layer (16). Thus, the heater (164, 166) will operate when the temperature of the medium (14) is not at the desired level.

Furthermore, a catalyst device (19) is mounted in the path between adjacent chambers (12,13). This can decrease the temperature (about 400° C.) of the medium (14) required to burn the volatile organic material in the steam, such that the efficiency of the incinerator will be further improved.

Even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An incinerator comprising:

a housing with multiple mutually communicating chambers defined therein;

a heat-storing medium received in each chamber;

a plurality of insulation layers respectively secured in said multiple chambers to divide each chamber into a plurality of heat storage areas for respectively receiving said heat-storing medium therein, each of said plurality of insulation layers having an orifice formed therethrough, said orifice in each of said insulation layers being located in displaced relationship with respect to an orifice in an adjacent insulation layer to form a spiral gas flow through said chambers;

at least one heater mounted in said housing;

an inlet tube and an outlet tube connecting to all of said chambers respectively;

a first control valve mounted between said inlet tube and each chamber;

a second control valve mounted between said outlet tube and each chamber; and an air pump mounted on said outlet tube, whereby said heat-storing medium in each heat storage area absorbs the heat generated by burning volatile organic material in industrial waste steam led into each chamber through said inlet tube, the industrial waste steam being treated by said medium in each of said heat storage areas one after the other.

2. The incinerator as claimed in claim 1, wherein said insulation layer is mounted laterally in each said chamber.

3. The incinerator as claimed in claim 1, wherein said insulation layer is mounted longitudinally in each said chamber.

4. The incinerator as claimed in claim 1, wherein said at least one heater is mounted laterally in one of said insulation layers.

5. The incinerator as claimed in claim 1, wherein said at least one heater is mounted longitudinally in one of said insulation layers.

6. The incinerator as claimed in claim 1 further comprising a temperature sensor mounted in said housing.

7. The incinerator as claimed in claim 1 further comprising a partition wall mounted between said adjacent chambers.

8. The incinerator as claimed in claim 1 further comprising a catalyst device mounted in the path between adjacent chambers.

9. The incinerator as claimed in claim 1, wherein said heat-storing medium is rock.

10. The incinerator as claimed in claim 9, wherein each rock has a diameter between 10 millimeters (mm) to 30 mm.

* * * * *